US005497814A

United States Patent [19]

Cannon

[11] Patent Number: 5,497,814

[45] Date of Patent: Mar. 12, 1996

[54] INVERTIBLE NO WASTE FUNNEL

[76] Inventor: John Cannon, P.O. Box 5, St. Elmo, Ala. 36568

[21] Appl. No.: 177,226

[22] Filed: Jan. 4, 1994

[51] Int. Cl.[6] ..... B65B 39/00

[52] U.S. Cl. ..... 141/331; 141/339; 141/106

[58] Field of Search ..... 141/331, 332, 141/333, 334, 335, 337, 340–345, 338, 339, 106; 4/283

[56] References Cited

U.S. PATENT DOCUMENTS

| | | | |
|---|---|---|---|
| 1,170,892 | 2/1916 | Graham | 141/331 |
| 1,265,381 | 5/1918 | Ramey | 141/339 |
| 1,359,730 | 11/1920 | Norton | 141/342 |
| 2,440,783 | 5/1948 | Peart | 4/283 |
| 4,949,405 | 8/1990 | Johnson | 4/283 |

*Primary Examiner*—Henry J. Recla
*Assistant Examiner*—Steven O. Douglas
*Attorney, Agent, or Firm*—Gregory M. Friedlander

[57] ABSTRACT

A funnel having a basin interior and near or at the top of the wall of the funnel. The basin serves to collect oil when the funnel is inverted and may drain to a low point in the basin when inverted. The basin may further drain to an exterior drain for purposes of draining the oil to a recycling reservoir. The basin and exterior drain may be designed to hold a sponge or rag to enhance reclamation of oil waste.

8 Claims, 3 Drawing Sheets

INVERTIBLE NO WASTE FUNNEL

BACKGROUND OF THE INVENTION

This invention relates to funnels.

More particularly this invention relates to funnels which may be inverted without spilling.

PRIOR ART

The closest known prior art is Ross L. Perkins, U.S. Pat. No. 2,174,228 which is described in the claims as having a splash flange projecting inward relations circumferentially from the body of the funnel.

This similar patent discusses down turned lips on the inner edge of the flange and projecting inwardly from the rim of the body and over 180 degrees.

Perkins, like other known prior art is directed to splash guards and not directed to a funnel for preventing spills and collecting oil.

The flanges are sloped inward slightly in order to prevent liquid accumulation. This touches away from the invention of Cannon because Cannon actually teaches accumulation within the basin which is otherwise dis-similar to the structures (flanges) refereed to in Perkins. Perkins has a flange which terminates at its ends this space circumferentially of tile funnel. The claims of Perkins provide for a gap which would defeat the purpose of the Cannon Specification. The reason for this difference is the different purpose, one is designed in order to prevent splashes and therefore wants any accumulated oils to leak down and where the other one is designed in order to prevent dripping in which case, allowing leakage in any fashion other than the controlled fashion described in the Cannon patent would be inappropriate.

Some of the similar prior art, which is less significant then Perkins, include Isaac J. Kosminsky, U.S. Pat. No. 1,358,218 which shows a different version of a non-spilling funnel having one lip extending over another lip. Kosminsky does nothing to allow for the collection or non-dripping of an inverted funnel.

Other patents not as similar are cited for the additional background that they provide.

The other patents are Norbert Wasser, U.S. Pat. No. 4,226,268; Kermit Black, U.S. Pat. No. 1,727,195; Jose J. Garza-Ondarza, U.S. Pat. No. 4,886,097; Nels Farden, U.S. Pat. No. 1,662,147 and Henry Bell, U.S. Pat. No. 267,133.

SUMMARY OF THE INVENTION

This invention is designed in order to have a funnel which may be inverted without spilling through the use of a basin interior to the funnel.

Features allow for the collection of oil from the preferred embodiment either by absorbing means or by allowing drainage into a collection reservoir.

The concept embodied in the patent is a funnel which is used for oil to drain in such a way as to not Effect the environment and to conserve oil as a secondary consideration.

In the preferred embodiment, the basin which collects the oil would extend completely around the entire circumference and is tilted at least when the funnel was inverted so as to have a pooling area for the oil.

This basin could provide a pooling area for collecting the oil in one spot or might allow the oil to drain to the exterior of the funnel. A removable sponge is provided for collecting the oil from at least the drainage area of the basin. The basin is shapped with a curved inner surface to hold a sponge and to simplify cleaning.

A further object is, therefore, to provide a funnel which collects oil in a fashion to reduce spillage and which can be easily cleaned.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF THE DRAWINGS

For a further understanding of the nature and objects of the present invention, reference should be made to the following detailed description taken in conjunction with the accompanying drawings in which like parts are given like reference numerals and wherein.

DETAILED DISCUSSION OF THE PREFERRED EMBODIMENT(S)

Figure 1:
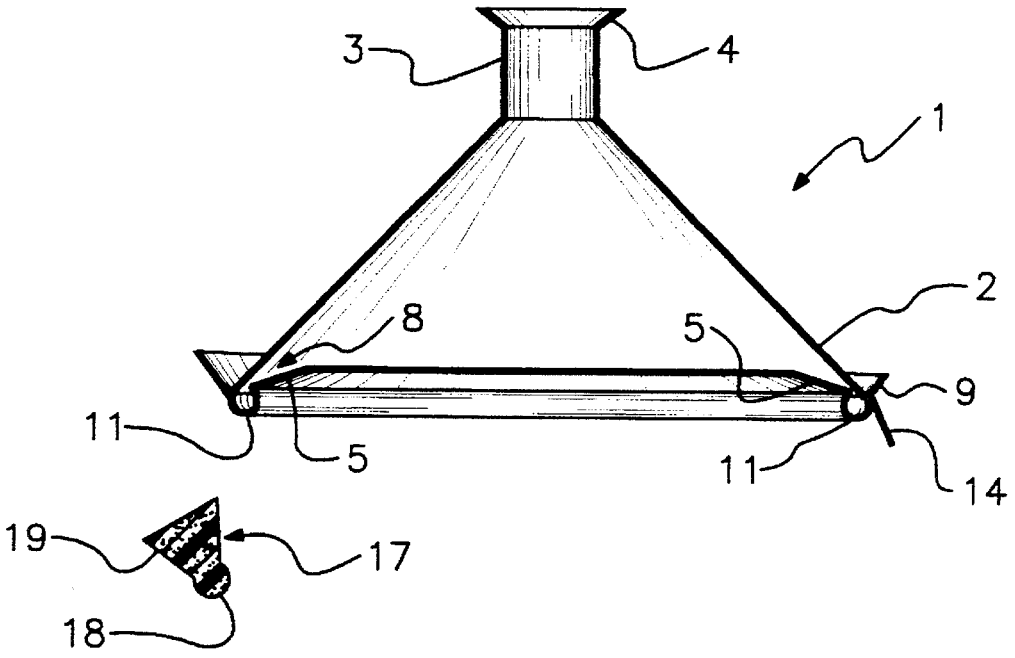
FIG. 1 is cross sectional view of the preferred embodiment in an inverted position.

The preferred embodiment comprises a funnel 1 having an expanded area 2 and a narrow draining area 3. The narrow area 3 may terminate with an expansion 4 in order to reduce the amount which would drip to the outside of the funnel 1 when it is vested.

The inside of the funnel 1 has a barrier means, in the preferred embodiment a basin 5, which is sloped from the circumference of the funnel 1 above the narrow area 3 towards the narrow area 3. Preferrably, this basin 5, is at or as close as possible to the top 6 of the funnel 1 opposite the draining area 3.

Oil when poured into the funnel 1 passes within the basin 5. Most oil which falls onto the basin 5 drips into the interior of the funnel. The shape of the funnel 1 and basin 5 is such as to allow the oil to pass over the basin 5 and within the funnel 1. When the funnel 1 is inverted the oil drains back into the basin 5.

Because the basin 5 need not collect much oil during any given use, it is possible to make it shallow and narrow. The pocket 11 of the basin 5 may be curved to allow it to be easily cleaned with a sponge, rag or fingertip. In addition, in the preferred embodiment, it is curved to define a cavity or holding pocket 11 for a shapped sponge 17. This sponge 17 is designed to absorb oil as is known in the art. The sponge 17 may fit in any number of parts of the basin 5, particularly the pooling area 8 as discussed in more detail below. Alternatively, it may fit within the drain 9 which is also described below. The sponge may be shaped to defining a barrier shape to replace the well part of the basin 5.

The sponge 17 has a rounded shaped area 18 designed to be compressed and held by the pocket 11 as well as an expanded area 19 which serves to fill, at least a protion of the basin 5 to provide for increased absorbtion.

In the preferred embodiment, the basin 5 is slanted to form a collecting means comprised of the slanted basin 5 and pooling area or collecting well 8. The basin 5 drains to this well 8 when inverted. In order to fully drain the basin 5, the basin 5 may curve to a lower point 15 within the interior of the funnel 1. In the preferred embodiment, the basin 5 is level with respect to the upper lip 6. To accomplish drainage to the collecting well 8, the upper lip 6 of the funnel 1 is shaped so that the basin 5 leans a lower point 15. In the preferred embodiment shown in FIG. 1 this is accomplished by having a notch 14 on one end of the upper lip 6 opposite the lower point 15 to tilt the entire funnel 1. In this way, the basin 5 drains to the lower point 15. This allows the basin 5 to slant only when inverted to run along the top 6 of the funnel 1.

Figure 2:
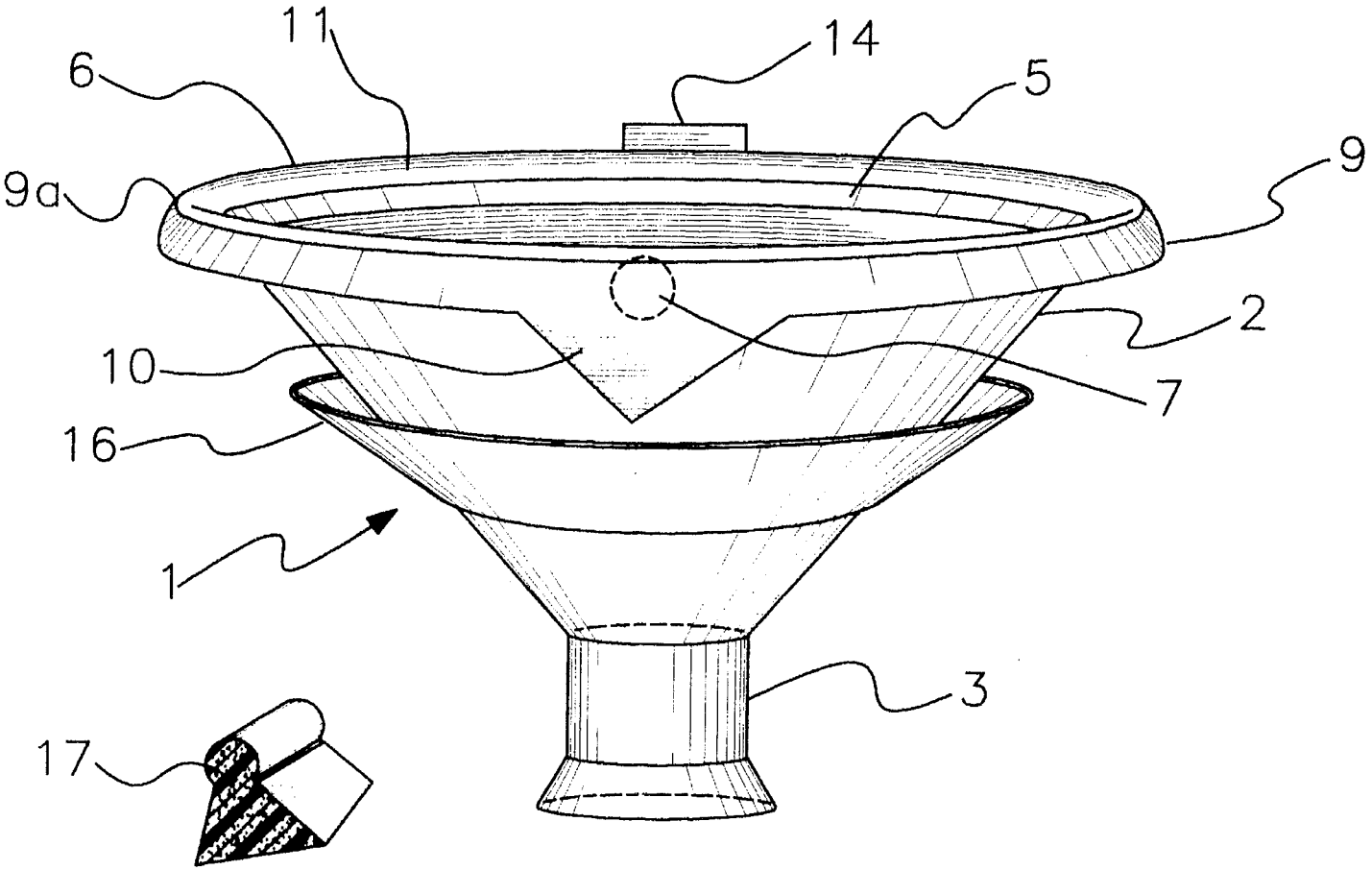
FIG. 2 is a perspective view of an alternate embodiment.

The basin 5 may, alternatively, be slanted so as to slope towards a lower area 15. In the embodiment shown in FIGS. 2 and 3 this lower area 15 communicates with drain 9 by way of opening 7 so that the oil trapped in the basin 5 tends to collect and flow out of the basin 5 into the collecting well 8 and then drain from the collecting well 8 through the opening 7 into the drain 9 and then into the lower part of the drain which is also the spout 10 and then to drain through spout 10 into a collecting container (not shown). A clip may be provided to hold the drain so it will drip into a collecting container (not shown).

In the preferred embodiment, the lower part of the collecting well 8 is at the same location as the lowest part of the basin 5. This outer collecting well 8 need not go around the entire outer wall of the funnel 1 since it only serves to collect oil from the inner surface.

This lower point 15 may have an opening 7 from the basin 5 to the outside of the funnel 1.

The purpose of the opening 7 is to allow oil collected in the basin 5 to flow from the basin 5 into a drain 9. The drain 9 may also slant into a lower area 10 and may have a sponge. This lower area 10 define a sport 10 in the preferred embodiment. When a sponge is not used, the funnel may be drained into a recycling container between uses. The sponge 17 may be replaced with a rag or other absorbing material to wipe out the basin pocket 5.

Figure 3:
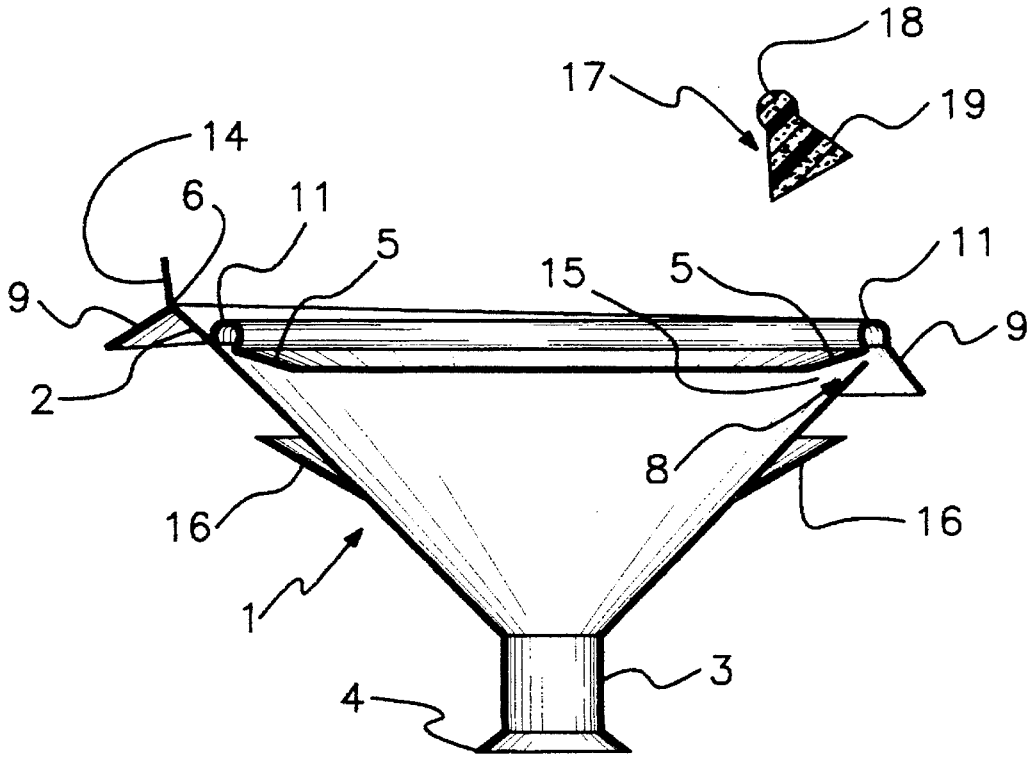
FIG. 3 is a cross sectional view of the alternate embodiment.

The sponge 17 is designed, in the embodiment with FIG. 3, to be able to block the opening 7 on the basin side or absorb oil coming out of the opening 7 on the drain 9 side selectively.

A very short outer reservoir 16 may be provided to prevent oil from the outer drain from dripping down the out side of the funnel 1. This outer reservoir 16 must, at least, be longer than the outer drain 9 collecting area 10 but also need not be around the entire funnel. This outer reservoir is designed to be shorter than the drain 9 so that when the funnel is in use, any oil in the outer reservoir 16 drips back into the drain 9.

The outer reservoir 16 and drain 9 and opening 7 may be eliminated in the preferred embodiment.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

I claim:

1. A funnel for inverting over a horizontal surface comprising (a) at least one wall having a reduced diameter at a first end, an increased diameter at a second end and defining an interior surface and an exterior surface and wherein the second end terminates in a rim;

(b) a barrier means for maintaining oil within the interior surface when the funnel is inverted so that the rim is substantially parallel to the horizontal surface, and wherein the barrier means further comprises a collecting means having at least one raised basin attached to the interior surface and wherein the collecting means further comprises a slanting means for slanting the basin such that a portion of the basin is disposed below the remainder of the basin to form a pooling area within the basin; and (c) said slanting means comprising a notch extending away from the rim of the funnel approximately opposite the pooling area so that the basin is tilted with respect to a horizontal surface when said funnel rests inverted so that the notch is resting on said horizontal surface such that collected oil drains to the pooling area.

2. The invention of claim 1 further comprising an opening in the at least one wall and wherein said opening is between the at least one wall and the basin allowing communication between the interior surface and the exterior surface.

3. The invention of claim 2 wherein the opening is located at the lowest point in the basin.

4. The invention of claim 2 further comprising a drain means for receiving oil from the at least one opening attached to the exterior surface of the funnel wall.

5. The invention of claim 4 wherein the drain means comprises a wall extending from the exterior surface of the wall between the opening and the rim and extending towards the first end.

6. The invention of claim 1 wherein the at least one wall defines a circumference and wherein the basin travels along the entire circumference of the wall interior surface.

7. The funnel of claim 1 wherein the slanting means comprises the basin defining a slope along the funnel interior surface so that a portion of the basin is below the level of the remainder of the basin when the funnel is inverted.

8. A funnel invertible over a horizontal surface comprising (a) at least one wall having a reduced diameter at a first end, an increased diameter at a second end, and defining an interior surface and an exterior surface and wherein the second end terminates in a rim;

(b) a barrier means for maintaining oil within the interior surface when the funnel is inverted, and wherein the barrier means further comprises a collecting means for collecting oil in a single location, and wherein the collecting means comprises at least one raised basin attached to the interior surface, and wherein the collecting means further comprises a slanting means for slanting the basin when said funnel in an inverted position such that the rim is approximately parallel to the horizontal surface such that a portion of the basin is disposed below the remainder of the basin to form a pooling area within the basin;

(c) an opening between the at least one wall and the basin allowing communication between the interior surface and the exterior surface; and (d) a drain means including a spout attached to the exterior surface of the funnel wall for receiving oil from the at least one opening.

* * * * *